US006609301B1

(12) United States Patent
Morris et al.

(10) Patent No.: US 6,609,301 B1
(45) Date of Patent: Aug. 26, 2003

(54) REINFORCED HYDROFORMED MEMBERS AND METHODS OF MAKING THE SAME

(75) Inventors: Brian Morris, Aurora (CA); Mark A. Kessen, Macomb Township, MI (US); Flavia F. Deveny, Troy, MI (US)

(73) Assignee: Magna International Inc., Aurora (CA)

( * ) Notice: Subject to any disclaimer, the term of this patent is extended or adjusted under 35 U.S.C. 154(b) by 59 days.

(21) Appl. No.: 09/657,514

(22) Filed: Sep. 7, 2000

Related U.S. Application Data

(60) Provisional application No. 60/152,601, filed on Sep. 8, 1999.

(51) Int. Cl.[7] ..... B23P 6/00

(52) U.S. Cl. ..... 29/897.1; 29/897.2; 29/421.1; 29/507; 29/523

(58) Field of Search ..... 29/890.036, 897, 29/897.2, 897.3, 897.1, 421.1, 506, 507, 522.1, 523, 525.13, 525.14, 235, 272, 280; 228/158, 126, 131; 138/153, 172, 174, 97, 98

(56) References Cited

U.S. PATENT DOCUMENTS

| | | | | |
|---|---|---|---|---|
| 2,344,779 | A | | 3/1944 | Kolderman et al. |
| 2,696,184 | A | | 12/1954 | Demarest |
| 2,809,602 | A | | 10/1957 | Heidmann |
| 3,486,703 | A | | 12/1969 | Sorlie |
| 3,572,073 | A | | 3/1971 | Dean |
| 3,583,187 | A | | 6/1971 | Kostranowski |
| 3,977,068 | A | * | 8/1976 | Krips |
| 4,151,632 | A | * | 5/1979 | Green |
| 4,567,743 | A | | 2/1986 | Cudini |
| 4,575,913 | A | * | 3/1986 | Sugiuchi et al. |
| 4,607,426 | A | * | 8/1986 | Kelly |
| 4,656,721 | A | * | 4/1987 | Werner |
| 4,660,269 | A | | 4/1987 | Suzuki |
| 4,759,111 | A | | 7/1988 | Cudini |
| 4,788,843 | A | | 12/1988 | Seaman et al. |
| 4,934,038 | A | * | 6/1990 | Caudill |
| 5,009,002 | A | * | 4/1991 | Kelly |
| 5,052,845 | A | * | 10/1991 | Maus et al. |
| 5,070,717 | A | | 12/1991 | Boyd et al. |
| 5,083,363 | A | * | 1/1992 | Ransom et al. ..... 29/523 |
| 5,107,693 | A | | 4/1992 | Olszewski et al. |

(List continued on next page.)

FOREIGN PATENT DOCUMENTS

| | | |
|---|---|---|
| CH | 385 146 | 3/1965 |
| CH | 385146 | 3/1965 |
| DE | 26 32 252 A1 | 1/1978 |
| DE | 26 32 252 | 1/1978 |
| DE | 98 31 047 A1 | 1/1999 |
| DE | 198 31 047 | 1/1999 |
| EP | 465 747 | 1/1992 |
| EP | 0 620 056 | 10/1994 |
| EP | 620 056 | 10/1994 |
| JP | 57-165134 | 10/1982 |
| JP | 63-220929 | 9/1988 |
| WO | WO 98/31485 | 7/1998 |
| WO | WO 98/51428 | 11/1998 |
| WO | WO 00/10748 | 3/2000 |

*Primary Examiner*—Gregory Vidovich
*Assistant Examiner*—T. Nguyen
(74) *Attorney, Agent, or Firm*—Pillsbury Winthrop LLP

(57) ABSTRACT

A method of hydroforming a reinforced tube comprising providing a metal tubular blank having an interior defined by an inner surface and an exterior defined by an outer surface. A metal reinforcing member is provided and inserted into the interior of the tubular blank. The reinforcing member is engaged with the inner surface of the tubular blank and is attached to the inner surface of the tubular blank. The tubular blank and reinforcing member welded thereto are placed into a hydroforming die having die surfaces defining a die cavity, and pressurized fluid is provided within the tubular blank so as to conform the tubular blank with the die surfaces of the die cavity.

5 Claims, 7 Drawing Sheets

U.S. PATENT DOCUMENTS

| | | | | |
|---|---|---|---|---|
| RE33,990 | E | | 7/1992 | Cudini |
| 5,233,854 | A | | 8/1993 | Bowman et al. |
| 5,235,836 | A | | 8/1993 | Klages et al. |
| 5,239,852 | A | | 8/1993 | Roper |
| 5,333,775 | A | | 8/1994 | Bruggemann et al. |
| 5,339,667 | A | | 8/1994 | Shah et al. |
| 5,557,961 | A | | 9/1996 | Ni et al. |
| 5,666,727 | A | * | 9/1997 | Rashid |
| 5,718,048 | A | | 2/1998 | Horton et al. |
| 5,824,998 | A | | 10/1998 | Livshiz et al. |
| 5,855,394 | A | | 1/1999 | Horton et al. |
| 5,899,498 | A | | 5/1999 | Horton |
| 6,082,353 | A | * | 7/2000 | van Doorn |
| 6,092,287 | A | * | 7/2000 | Thoms |

* cited by examiner

REINFORCED HYDROFORMED MEMBERS AND METHODS OF MAKING THE SAME

This application claims the benefit of provisional application No. 60/152,601 filed Sep. 8, 1999.

BACKGROUND OF THE INVENTION

The process of hydroforming metal structural components is well known. See, for example, U.S. Pat. Nos. 5,107,693, 5,233,854, 5,333,775, 4,567,743, 5,070,717, 5,239,852 and 5,339,667, the disclosures of which are hereby incorporated by reference. In a conventional hydroforming process, a tubular metal blank member, typically a piece of sheet metal formed into a generally cylindrical tube, is placed into a die cavity of a hydroforming die. Opposite ends of the tube are sealed, and fluid is injected under pressure internally to the tubular blank so as to expand the blank outwardly into conformance with the interior surfaces defining the die cavity. In more recent improvements to the conventional hydroforming process, opposite ends of the tubular blank are compressed longitudinally toward one another during outward expansion of the tube so as to replenish the wall thickness of the metal as it is expanded outwardly. An exemplary process for replenishing material by longitudinally compressing the blank is disclosed in U.S. Pat. Nos. 5,899,498, 5,855,394, and 5,718,048, and commonly-assigned U.S. patent application Ser. No. 09/061,094 filed Apr. 16, 1998 and Ser. No. 08/915,910, filed Aug. 21, 1997, the disclosures of which are hereby incorporated by reference.

An advantage to hydroforming tubular parts is that parts having varying irregular cross-sectional configurations can be made quite easily, which would be extremely difficult if not impossible to accomplish using roll-forming techniques.

In the conventional hydroforming processes, the final hydroformed component will have a wall thickness that is substantially constant throughout the component or, if it varies at all, such variation cannot be easily controlled, particularly to address situations where significant variations in wall thickness is desired. Subsequent processing of the component or intended applications of the component can create the need for localized increased strength or stiffening. Under conventional hydroforming techniques, a thicker tubular blank can be used to accommodate localized strength requirements, so that the overall thickness of the formed part is determined by the greatest localized strength requirements. Such components are, however, unnecessarily heavy, and material costs for forming such components can become unnecessarily high.

A hydroforming technique for accommodating localized strength requirements is discussed in U.S. Pat. No. 5,333,775, the disclosure of which is hereby incorporated by reference. The '775 patent discloses a method of manufacturing certain portions of a hydroformed member stronger than others by providing plural tubular blank portions of different wall thicknesses welded end-to-end, so that the completed hydroformed member will have a greater wall thickness at desired locations. The method disclosed in this patent is, however, rather tedious and is thereby process-intensive and expensive.

Other methods have proposed to provide a localized exterior sleeve in surrounding relation to an inner tubular blank. The inner tubular blank is expanded until it engages the interior surface of the exterior sleeve, whereupon further expansion of the inner tubular blank causes concurrent expansion of the exterior sleeve until the exterior sleeve is moved into engagement with the surface defining the hydroforming die cavity. While the exterior surface may provide localized reinforcement, it entirely surrounds the inner tube and thus again provides more metal material than what may be desired. In addition, because the exterior sleeve surrounds the inner tube, it may inhibit desired expansion of the blank, particularly where the hydroformed tube is to be expanded into a corner, and particularly where high gauge metal is desired for the reinforcement.

SUMMARY OF THE INVENTION

The foregoing drawbacks of conventional hydroforming processes are overcome in accordance with the concepts of the present invention in which a tubular blank to be hydroformed is locally reinforced in such a manner as to accommodate localized strength or stiffening requirements. In particular, the forgoing drawbacks are overcome by a method of hydroforming a reinforced tube which includes the steps of providing a metal tubular blank having an interior defined by an inner surface and an exterior defined by an outer surface. A metal reinforcing member is provided and inserted into the interior of the tubular blank. The reinforcing member is engaged with the inner surface of the tubular blank and is attached to the inner surface of the tubular blank. The tubular blank and reinforcing member welded thereto are placed into a hydroforming die having die surfaces defining a die cavity, and pressurized fluid is provided within the tubular blank so as to conform the tubular blank with the die surfaces of the die cavity.

The forgoing disadvantages are also overcome in accordance with aspects of the present invention by a method of hydroforming a vehicle frame member. Sheet metal is formed into a generally conical tubular configuration and is seam-welded to form a generally conical tubular blank. The conical tubular blank is placed into a hydroforming die having die surfaces defining a die cavity, and pressurized fluid is provided within the conical tubular blank so as to conform the conical tubular blank into conformity with the die surfaces of the die cavity. A second tubular blank is placed into a second die cavity, and pressurized fluid is provided within the second tubular blank so as to conform the second tubular blank into conformity with surfaces defining the second die cavity. After conforming the conical tubular blank and the second tubular blank, one end of the conformed conical tubular blank is welded to one end of the second tubular blank.

In accordance with another aspect of the present invention, a generally flat reinforcing member is attached to a surface of a generally flat metal sheet to form a composite sheet. The composite sheet is formed into a reinforced tubular blank, and the reinforced tubular blank is placed into a hydroforming die and thereafter conformed to die surfaces of the die.

According to still another aspect of the present invention a hydroformed part including hydroformed tubular member and a metal reinforcing member attached to a surface of the hydroformed member before a hydroforming process. Thus, the reinforcing member is also hydroformed to maintain conforming contact with the hydroformed tubular member.

Other objects, features, and characteristics of the present invention, as well as the methods of operation of the invention and the function and interrelation of the elements of structure, will become more apparent upon consideration of the following description and the appended claims with reference to the accompanying drawings, all of which form a part of this disclosure, wherein like reference numerals designate corresponding parts in the various figures.

DETAILED DESCRIPTION OF THE PREFERRED EMBODIMENTS

Figure 1:
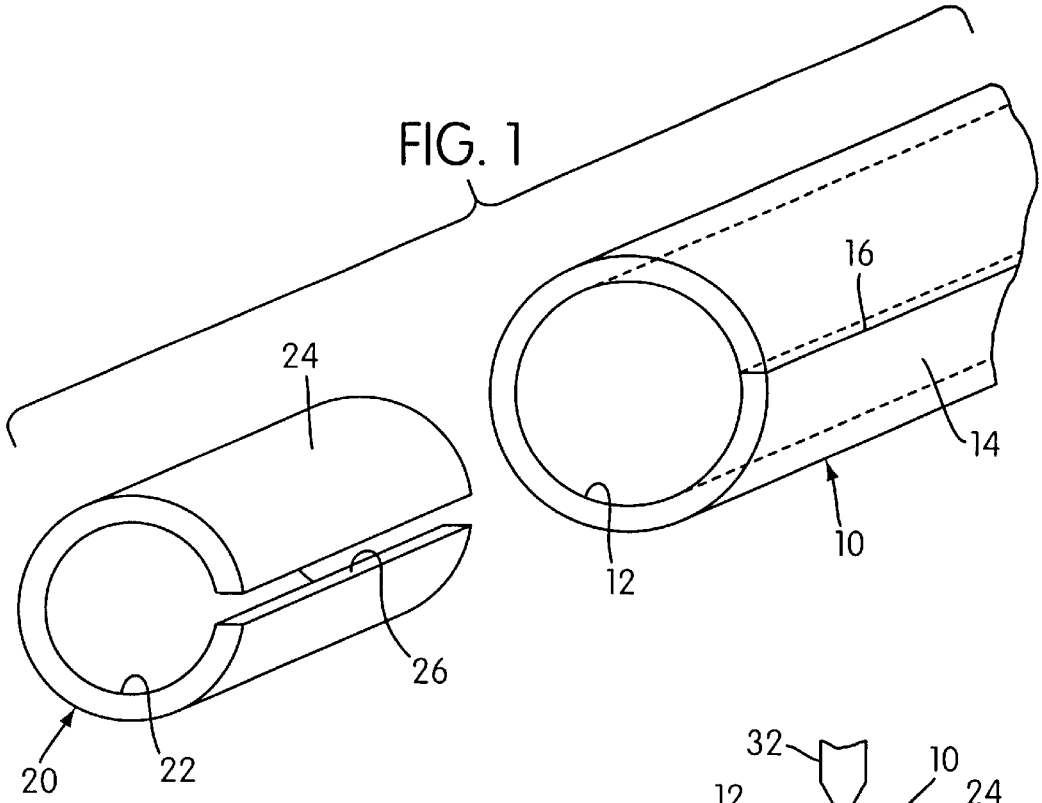
FIG. 1 is an exploded perspective view showing a tubular blank and a reinforcing member according to the present invention.
Figure 2:
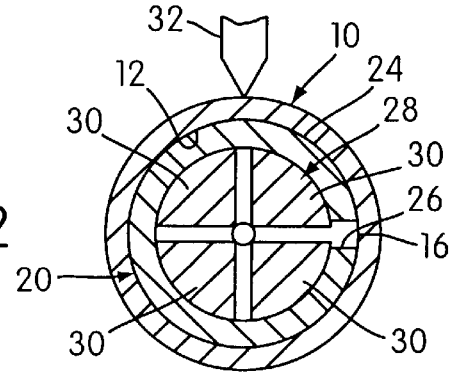
FIG. 2 is a transverse cross section showing a tubular blank, a reinforcing member inside the tubular blank, an expanding mandrel inside the reinforcing member, and a welding apparatus on the outside of the tubular blank.
Figure 3:
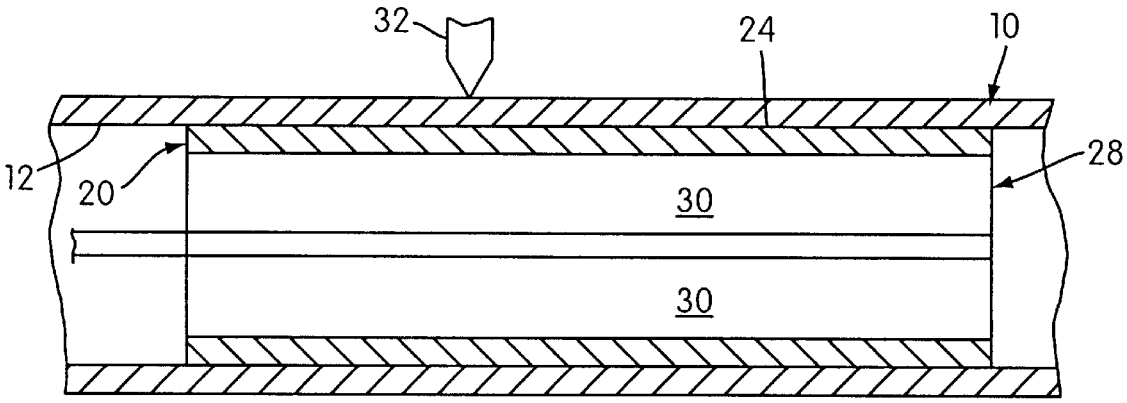
FIG. 3 is a longitudinal cross-sectional view of a tubular blank, a reinforcing member inside the tubular blank, an expanding mandrel inside the reinforcing member, and a welding apparatus on the outside of the tubular blank.

A tubular metal blank 10 reinforced in accordance with aspects of the present invention is shown in FIGS. 1–3. The tubular blank 10 is typically comprised of a piece of sheet metal formed into a tubular element defining an inner surface 12, an outer surface 14, and a seam-weld 16 at which the opposite edges of the sheet metal are attached to one another. The metal tubular blank 10 is preferably formed from steel, with the exact type and gage of steel depending on the intended application of the hydroformed component.

In accordance with one aspect of the invention, a reinforcing member 20 is formed so as to be partially tubular, having an open cross-section at 26 and defining an inner surface 22 and an outer surface 24. The reinforcing member 20 has an axial extent which corresponds to the axial extent to which the blank 10 is to be reinforced and is arranged generally coaxially with the blank 10. Outer surface 24 preferably defines an outer diameter of the reinforcing member 20 that is slightly less than an inner diameter defined by the inner surface 12 of the tubular metal blank 10, so that the reinforcing member 20 can be easily inserted into the tubular metal blank 10, but without having a large gap between outer surface 24 and inner surface 12.

Preferably, the material of the reinforcing member 20 is the same as that of the blank 10.

The reinforcing member 20 is secured inside the metal tubular blank 10 by inserting the reinforcing member 20 into the interior portion of the metal tubular blank 10 and then expanding the reinforcing member 20 with an expanding mandrel 28 inserted inside the reinforcing member 20. The expanding mandrel 28 may be of conventional design and operation and may include a plurality of radially expandable portions 30 (four such portions are shown in FIG. 2). The radially expandable portions 30 of the expanding mandrel 28 expand the metal reinforcing member 20 outwardly. Expansion of the metal reinforcing member 20 by the mandrel 28 is facilitated by the open cross-section 26. The metal reinforcing member 20 is expanded until the outer surface 24 thereof is in generally continuous contact with the inner surface 12 of the metal tubular blank 10. The metal reinforcing member 20 and the metal tubular blank 10 are then secured to one another by means of a welding apparatus 32, preferably a laser welding apparatus capable of one side access welding, which is applied from the outer surface 14 of the metal tubular blank 10 so as to fuse the metal reinforcing member 20 to the inner surface 12 of the metal tubular blank 10. The reinforcing member 20 may be welded to the metal blank 10 along one or more edges of the reinforcing member 20 and/or it may be spot welded at corners of the member 20.

Figure 4A:
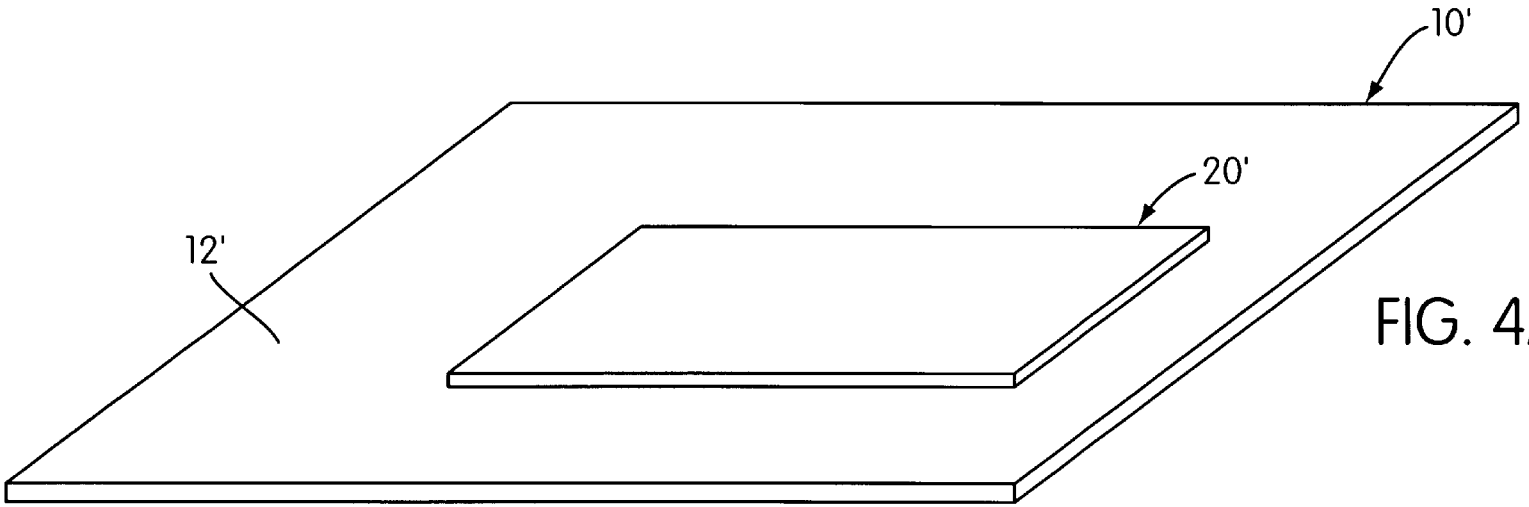
FIG. 4A is a perspective view showing a flat metal sheet with a flat reinforcing member secured thereto.
Figure 4B:
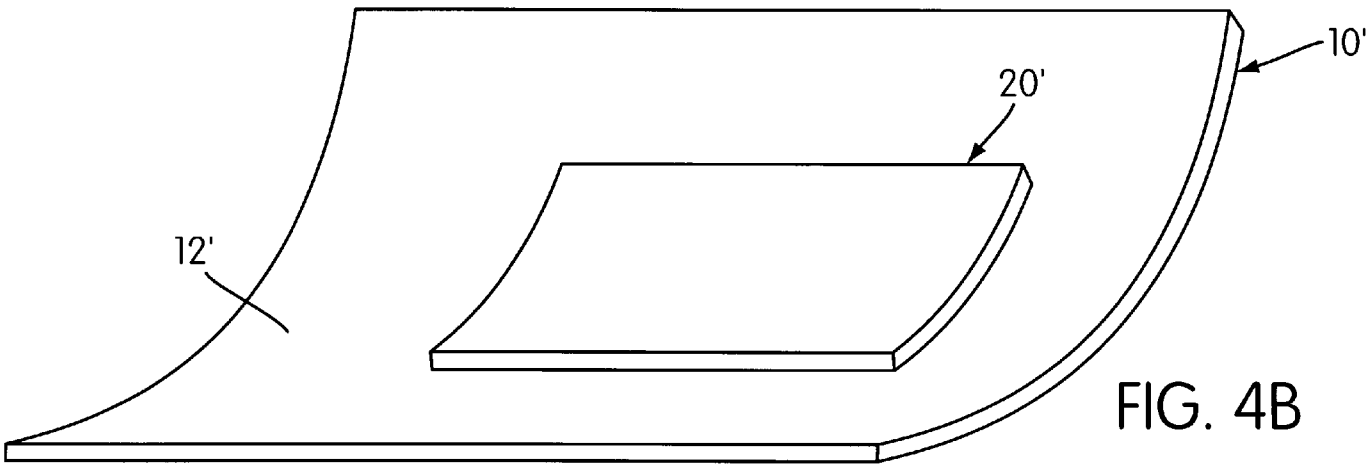
FIG. 4B is a perspective view showing the metal sheet and reinforcing member of FIG. 4A partially rolled into a tubular blank.

An alternative method for forming a reinforced tubular metal blank is shown in FIGS. 4A and 4B. A flat reinforcing sheet 20' is secured to a surface 12' of a flat metal sheet 10', and the composite sheet laminate is then formed into a tubular form. The mating edges of the rolled composite sheet are welded to form a seam welded reinforced tubular blank. The reinforcing member 20' is preferably welded to the metal blank 10' along one or more edges (preferably at least two opposing edges) of the reinforcing member 20' and/or it may be spot welded at corners of the member 20'. It is also contemplated that the reinforcing member may be peripherally welded along all of its edges. Welding at any of such locations of the reinforcing member is contemplated for each of the embodiments disclosed herein. The reinforcing member 20' may be rectangular as shown in the figures or it may be of some other shape (e.g., circular, oval, trapezoid, skewed parallelogram). The composite sheet can be rolled so that the surface 12' and the reinforcing member 20' are on the inside of the formed tubular blank, as shown in FIG. 4B, or the composite sheet can be rolled in an opposite orientation with the surface 12' and 20' on the outside of the formed tubular member.

Figure 5:
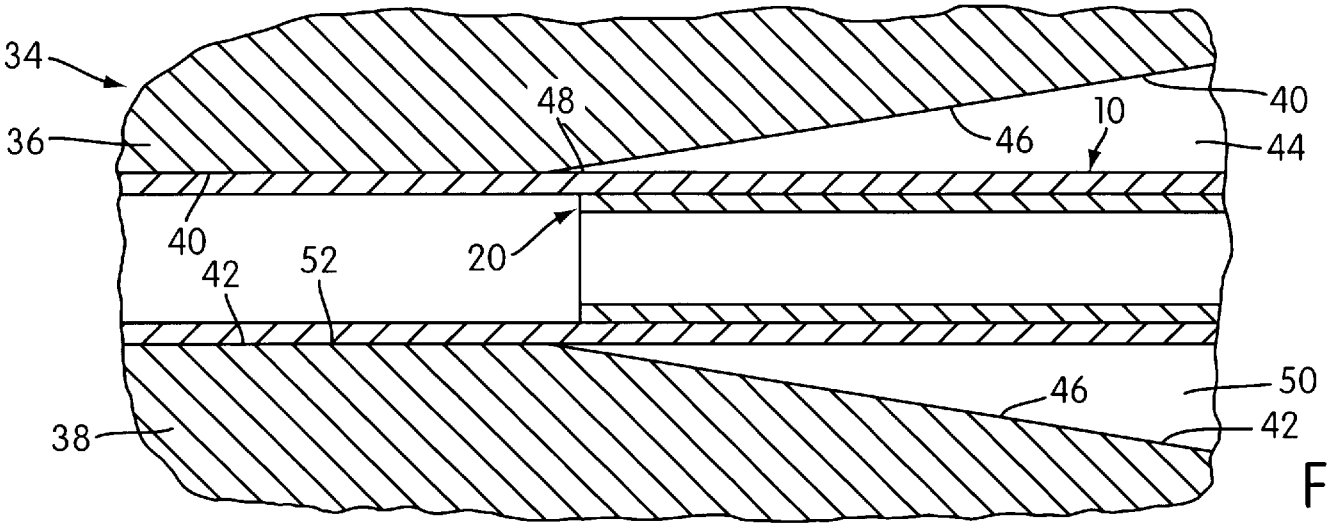
FIG. 5 is a partial longitudinal cross-sectional view of a hydroforming die with a reinforced tubular blank disposed therein.
Figure 6:
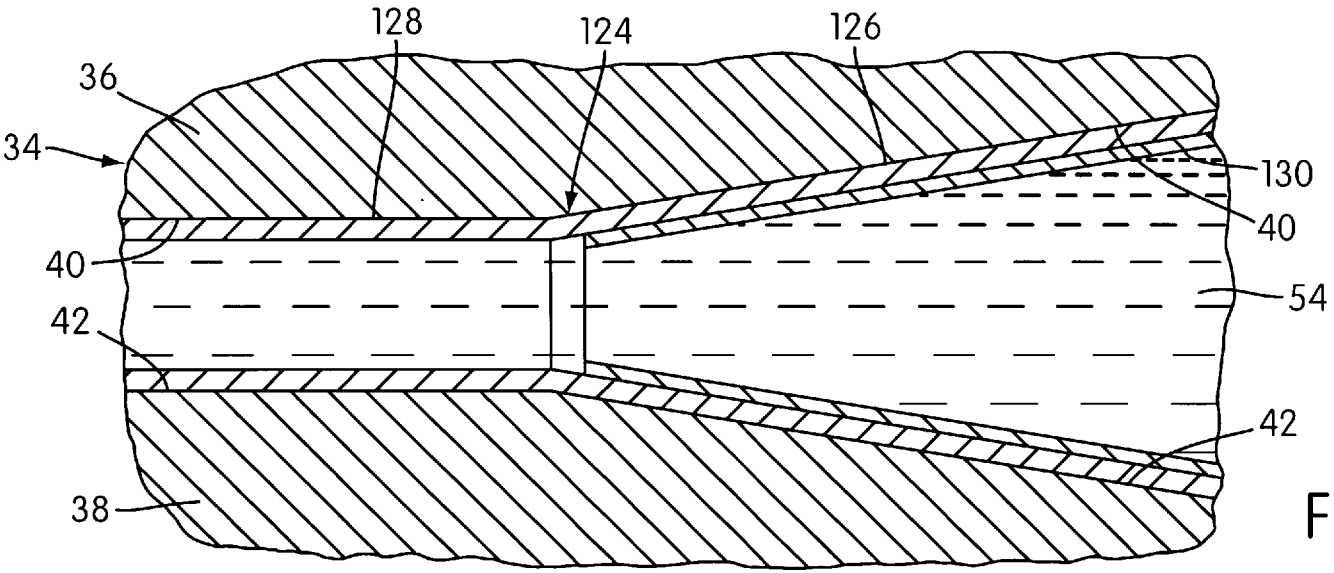
FIG. 6 is a longitudinal cross-sectional view of a hydroforming die with a reinforced tubular blank disposed therein, wherein the tubular blank is under fluid pressure and is expanded into conformity with the die surfaces of the die cavity.

The hydroformed metal blank 10 (or 10'), reinforced by the reinforcing member 20 (or 20') as previously described, is shown in FIGS. 5 and 6. The reinforced metal tubular blank 10 is placed inside a hydroforming die 34, comprising an upper portion 36 and a lower portion 38 which respectively include upper die surfaces 40 and lower dies surfaces 42, which surfaces together define a die cavity 44. In one exemplary arrangement, the die cavity 44 may include a non-expanding (or less expanding) portion 52, having a generally constant cross-section, and an expanding portion 46, having a first end 48 of a diameter generally the same as that of the non-expanding portion 52 and a second end 50 of a diameter greater than that of the first end 48. The preferred hydroforming die assembly is one that is manufactured in accordance with U.S. application Ser. No. 08/915,910, which has been incorporated herein by reference.

The reinforced metal tubular blank 10 is placed in the die cavity 44 so that the reinforcing member 20 is disposed at a section in which increased localized strength or stiffening will be required in the formed component. Fluid 54 is then injected under pressure into the metal tubular blank 10, thereby causing the metal tubular blank 10 and the metal reinforcing member 20 secured thereto to expand or conform to the shape of the upper die surfaces 40 and the lower die surfaces 42 as shown in FIG. 6. The result is a hydroformed member 124 having an expanded portion 126 including the expanded reinforcing member 130 secured thereto, and a non-expanded or less-expanded portion 128. The additional material provided by the metal reinforcing member 20 (or 20'), which becomes the expanded reinforcing member 130, reinforces the expanded portion 126 of the hydroformed member 124.

Figure 7:
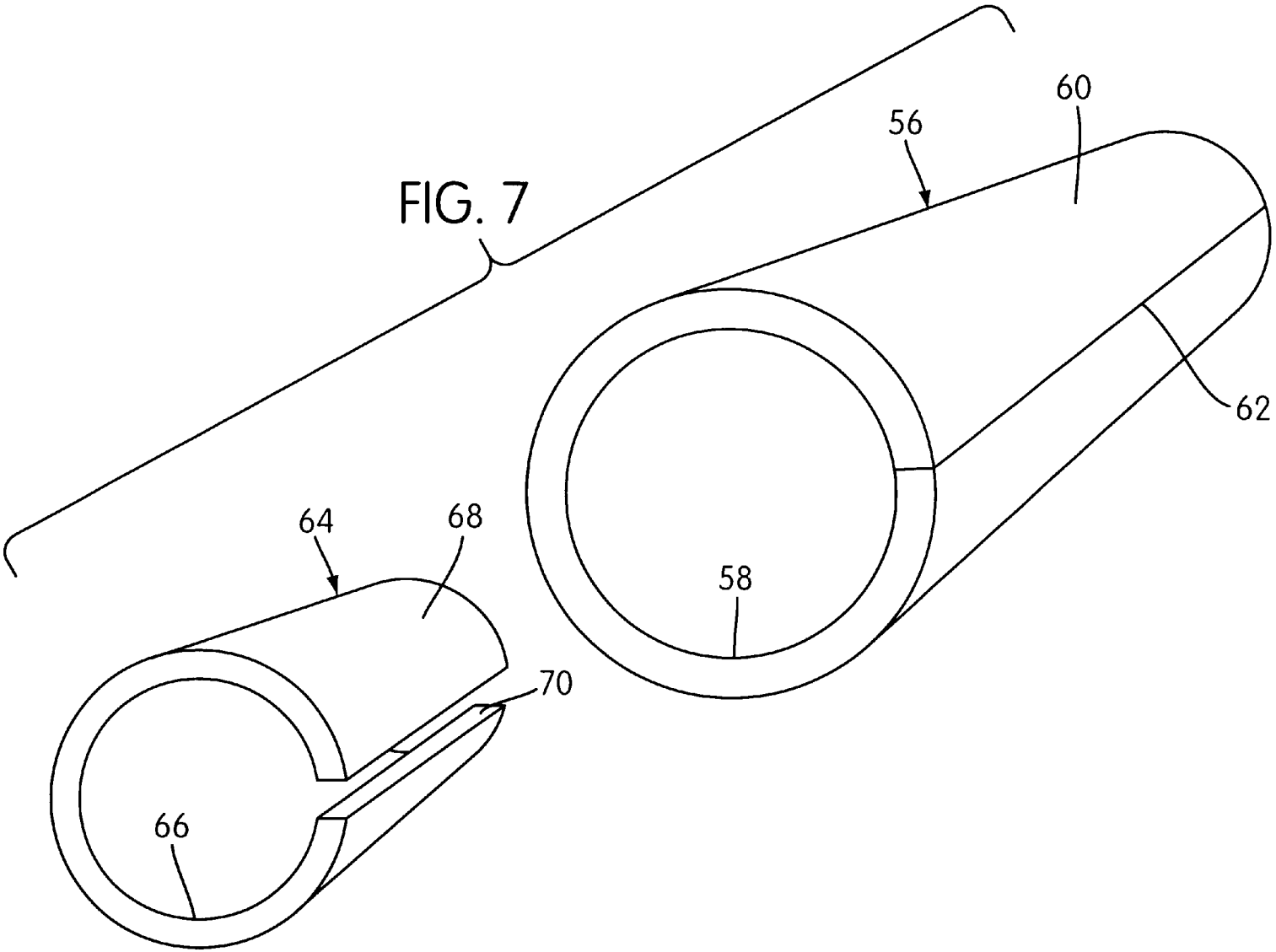
FIG. 7 is an exploded perspective view of a conical tubular blank and a conical reinforcing member.

As shown in FIG. 7 in accordance with another aspect of the present invention, a metal blank 56 is initially roll-formed into a generally conical shape so as to accommodate larger expansion at one end thereof in comparison with an opposite end thereof. The opposite ends of the conical blank 56 can have diameters more closely corresponding to the final transverse dimensions of the ends of the hydroformed part. Thus, the amount of local expansion required at the larger end is not excessive, thereby avoiding excessive wall thinning in the blank during expansion. In a preferred embodiment, the larger diameter end of the conical blank has a diameter that is more than 10% greater than the diameter at the smaller diameter end of the blank.

In a preferred embodiment, the blank 56 is formed of sheet metal roll-formed into a conical shape and seam-welded at 62, thereby defining an interior surface 58 and an exterior surface 60.

In accordance with one aspect of the present invention, the larger diameter end of the conical tubular blank can be butt-welded to a second tubular blank having an end with the same diameter and configuration of the larger diameter end of the conical tubular blank. The second tubular blank can itself be roll formed into a conical configuration with its larger diameter end butt-welded and thus sealed to the larger diameter end of the first tubular blank. The butt-welded blanks can then be hydroformed together as a unit in a hydroforming die press, as the opposite relatively smaller ends of the welded blanks are sealed by hydraulic rams, and the welded tubular blank hydraulically expanded.

In another aspect of the invention, the tubular conical blank is first hydroformed, and the large end diameter of the resultant part is then butt-welded to a second tubular member which has an end of the same general size and configuration as the larger diameter end of the hydroformed part. For this application, the second tubular member may optionally have been hydroformed itself prior to being butt-welded to the first part. It is also contemplated that the second tubular member be a part that was also hydroformed from a conical blank, as with the first part, and the resultant hydroformed parts butt-welded after the hydroforming operations.

In another embodiment, a conical metal reinforcing member 64 can be used in conjunction with a conical metal tubular blank 56 to be hydroformed. The conical reinforcing member 64 is roll-formed from sheet metal thereby defining an inner surface 66, an outer surface 68, and an open cross-section at 70. The outside diameter profile of the reinforcing member 64 is such that the reinforcing member 64 can fit inside the conical metal tubular blank 56. After the conical metal reinforcing member 64 is inserted into the conical metal tubular blank 56, the reinforcing member 64 can be expanded by means of a conventional expanding mandrel, as described above, so that the outer surface 68 of the reinforcing member 64 is in generally uniform contact with a portion of the inner surface 58 of the conical blank 56. The reinforcing member 64 is then welded to the conical blank 56 from outside the outer surface 60.

As an alternative to expanding a conical reinforcing member inside a conical blank by means of a mandrel, the conical reinforcing member can be inserted into the conical blank until the narrowing diameter of the blank causes the conical reinforcing member to become wedged into the blank. The conical reinforcing member can then be welded in place. The conical reinforcing member and the conical blank should have generally the same angle and have generally the same transverse shape to ensure proper contact between the outer surface of the conical reinforcement and the inner surface of the conical blank.

Alternatively, a flat reinforcing member can be welded to a flat metal sheet, as shown in FIG. 4A and described above, and the composite sheet can be rolled into a conical form and seam-welded to form a conical blank.

Figure 8:
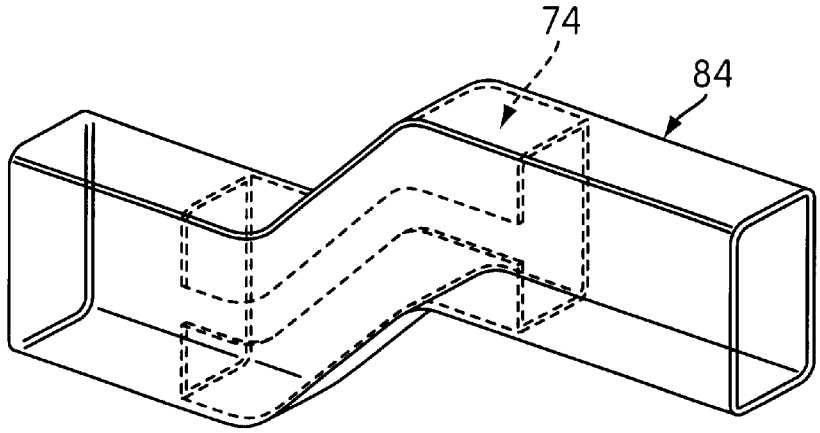
FIGS. 8–10 are perspective views of hydroformed members formed from tubular blanks that have been reinforced with reinforcing members of varying size and that have been bent prior to hydroforming.
Figure 9:
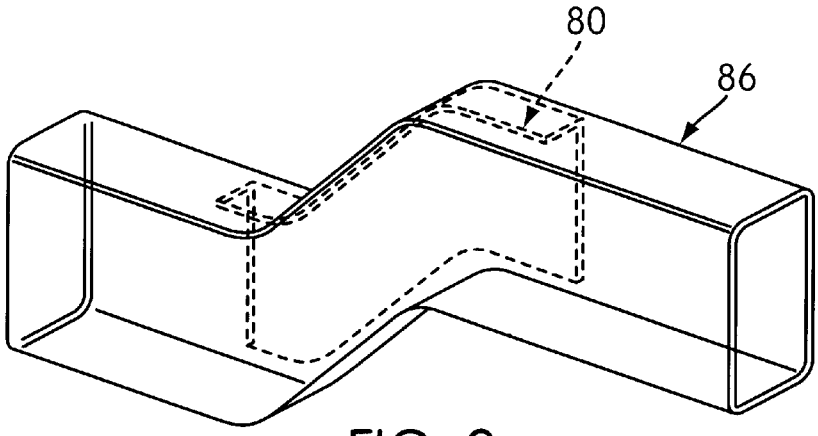
Figure 10:
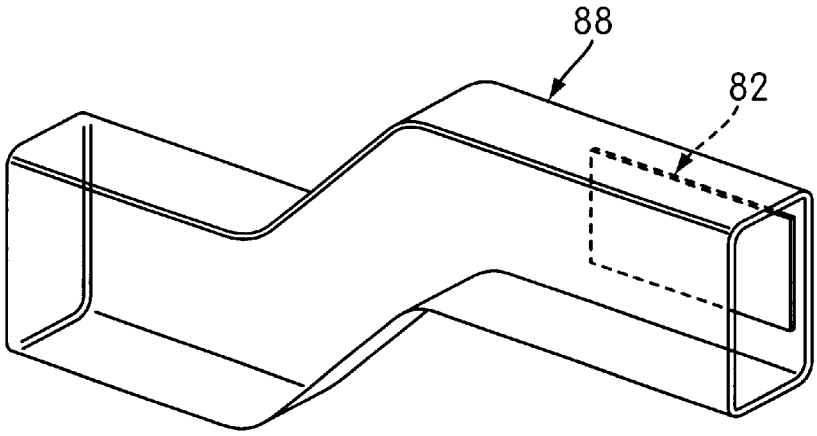

Various examples of reinforced hydroformed members are shown in FIGS. 8–10. Each of the hydroformed members 84, 86, and 88 shown in FIGS. 8, 9, and 10, respectively, is hydroformed from a reinforced tubular metal blank, which may be cylindrical or conical and have a circular or oval or other initial cross-sectional shape. The size of the respective reinforcing members 74, 80, and 82, and therefor the extent of localized strengthening or stiffening, progressively decreases from FIG. 8 through FIG. 10. Hydroformed member 84 shown in FIG. 8 is formed from a blank having a reinforcing member 74 which substantially covers the inner periphery of a portion of the blank, such as the reinforced blank shown in FIG. 1. Hydroformed member 86 shown in FIG. 9, on the other hand, is formed from a blank having a reinforcing member 80 which only covers about half the inner periphery of the blank. Hydroformed member 88 shown in FIG. 10 is formed from a blank having a reinforcing member 82 attached to an inner surface of a blank and covering some portion of the blank less than half the inner periphery. The hydroformed members 84, 86, and 88 are reinforced so as to accommodate localized strength requirements with the size and shape of the reinforcing member being selected based on the particular localized strength requirements. The reinforcing members 74, 80, and 82 shown in FIGS. 8, 9, and 10, respectively, are rectangular in shape, but, again, the reinforcing member may be of any shape depending on factors, such as strength and weight considerations. Furthermore, the reinforcing members 74, 80, and 82 will not initially have flat surfaces as shown in FIGS. 8–10, but will have an arcuate shape conforming to the arcuate surface of the blank prior to hydroforming.

Figure 11:
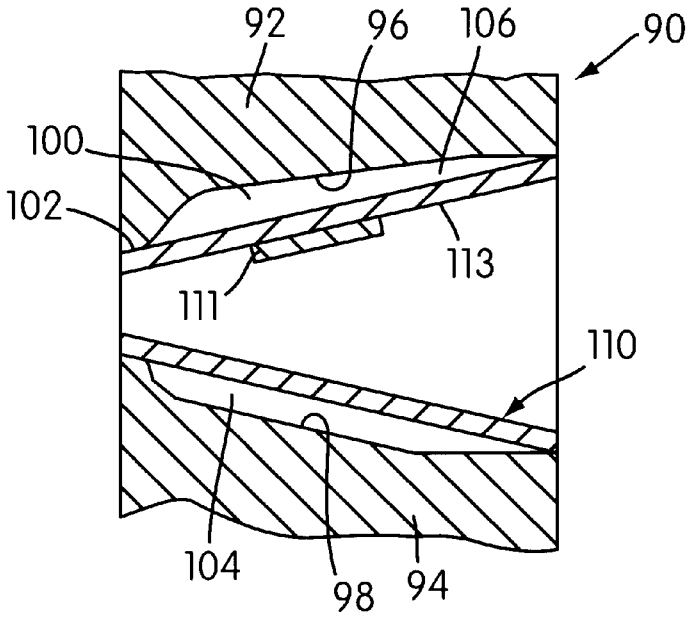
FIG. 11 is a partial cross-sectional view of a hydroforming die with a conically-shaped tubular blank disposed therein.

A hydroforming die for expanding a tubular metal blank into a component having differing transverse dimensions at opposite ends thereof is shown in FIG. 11. The hydroforming die 90 includes an upper portion 92 having an upper die surface 96 and a lower portion 94 having a lower die surface 98. When the upper portion 92 and lower portion 94 are placed together, the upper die surface 96 and lower die surface 98 define a die cavity 100. The die cavity 100 includes non-expanding portion 102, a first expanding portion 104 that is constructed and arranged to expand a first portion of the conical roll-formed blank 110 to a first predetermined extent, and a second expanding portion 106 that is constructed and arranged to expand a second portion of the conical roll-formed blank 110 to a second predetermined extent which is greater than the first predetermined extent.

The tubular blank 110 is placed in the die cavity 100. In the illustrated embodiment, blank 110 is a conical metal blank. The metal blank can be optionally reinforced by a reinforcing member 111 welded to an interior surface 113 of the blank. After the metal blank 110 is placed in the die cavity 100 and the upper and lower portions 92, 94 of the die are brought together, pressurized fluid 108 is injected into the blank 110, thereby expanding the blank 110 into a hydroformed element 114 conforming to the upper die surface 96 and lower die surface 98 as shown in FIG. 12.

The terms conical and generally conical, as used herein in relation to the tubular blanks 56 and 110, for example, are intended to be synonymous to one another and refer to what is known as frusto-conical by those skilled in the art. The term frusto-conical (and hence conical and generally conical as used herein) refers generally to a truncated cone shape, as opposed to a purely conical configuration that ends in a point. It can be appreciated from the figures that the tubular blanks 110 and 56 illustrate this generally conical shape.

Figure 12:
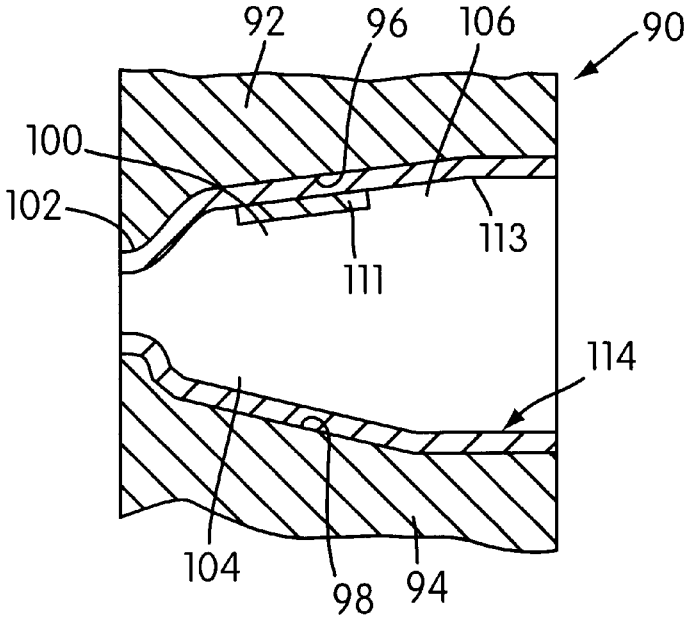
FIG. 12 is a cross-sectional view of a hydroforming die and a member disposed therein and hydroformed under fluid pressure into a component having a diameter at a left end thereof that is smaller than a diameter of a right end thereof.

As can be appreciated from FIG. 12, one of the advantages of the hydroforming process is that a hydroformed part or element 114 can be formed that has an irregular shape with a varying cross-section at different portions along its longitudinal extent. This is accomplished by expanding the tubular blank to different extents and/or into different cross-sectional shapes along different portions thereof. Otherwise stated, the hydroformed element 114 is defined by an irregularly outwardly deformed tubular metallic wall that is fixed into a predetermined irregular exterior surface configuration that conforms to the surfaces of the die cavity.

Figure 13:
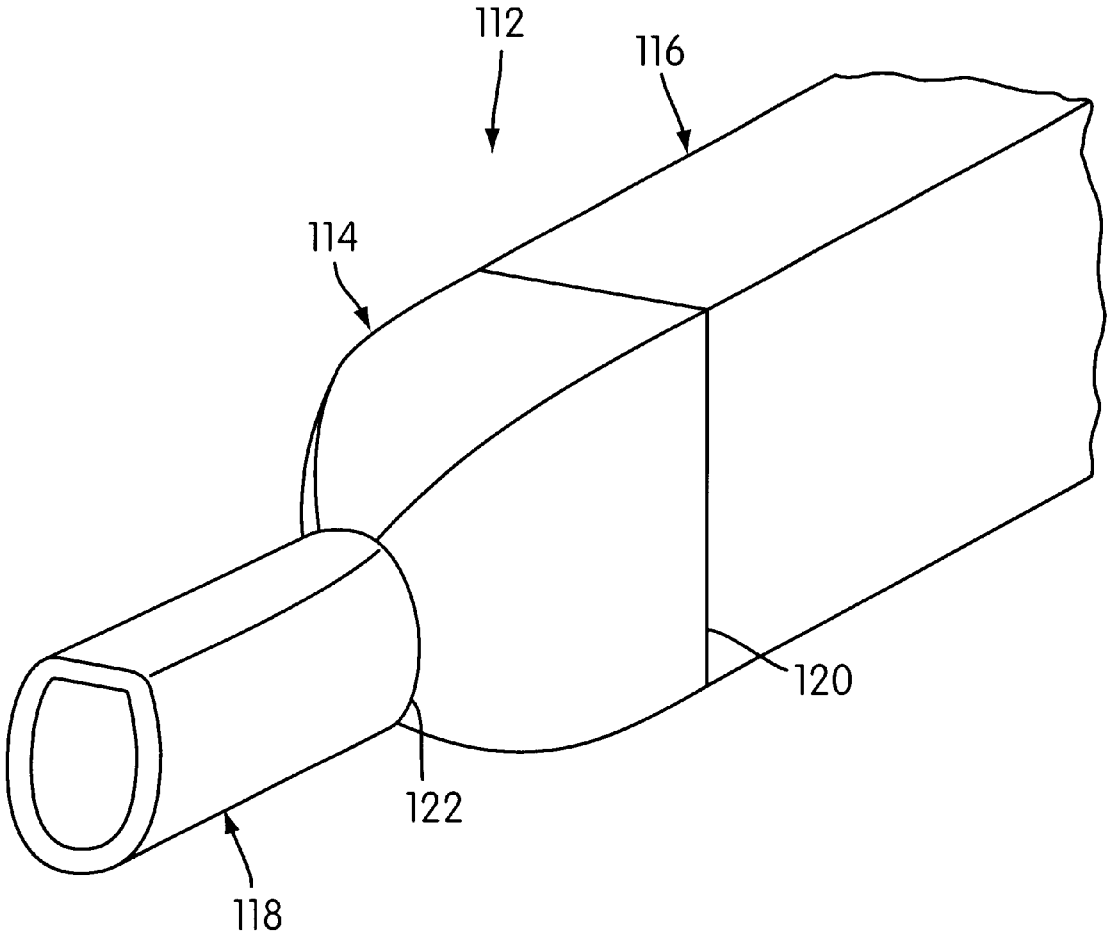
FIG. 13 is a partial perspective view of a hybrid frame assembly constructed in accordance with aspects of the present invention.

A hybrid frame assembly 112 formed in accordance with aspects of the present invention is shown in FIG. 13. The hybrid frame assembly 112 includes the first hydroformed element 114 such as that shown and described in conjunction with FIGS. 11 and 12 above. A second, rectangular-shaped hydroformed element 116 is butt-welded at 120 to the first hydroformed element 114. A third, irregularly shaped hydroformed element 118 with a much smaller cross-sectional dimension than the second hydroformed embodiment 116, is butt-welded at 122 to the first hydroformed element 114. By this method, a hybrid metal component having extents of differing shapes can be constructed by separately hydroforming the two or more constituent elements defining different extents of the component and butt-welding the elements to form the hybrid component. In FIG. 13, the first hydroformed element 114 functions as a transitional member that connects two tubular elements 116, 118 having very different cross-sectional dimensions (one being larger than the other). The hybrid frame assembly 112 shown in FIG. 13 is merely illustrative and can include combinations of circular, round, or other-shaped hydroformed members in combination with hydroformed members made from a conical or reinforced tubular metal blank.

In each of the forgoing embodiments of a reinforced tubular blank for hydroforming or bending, the reinforcing member is disposed on an interior portion of the tubular blank, whether inserted into a pre-formed tubular blank or attached to a flat sheet of metal and thereafter rolled into a tubular blank. It is within the contemplate scope of the present invention, however, to place a reinforcing member onto an exterior surface of a tubular blank to be hydroformed and weld the reinforcing member to the exterior surface prior to hydroforming the tubular blank. As when the reinforcement is provided on the interior, the reinforcing member can be welded to the sheet metal either before it is roll formed into the tubular blank configuration or it can be welded to the exterior surface after the tube has already been formed. Providing a welded reinforcement on the exterior surface is less preferred than placing the reinforcing member inside the tubular member, because an exteriorly placed reinforcing member can detract from the aesthetic appearance of the hydroformed part and can lead to larger localized stresses. In addition, where the reinforced area is to be drilled or pierced therethrough for a fastened connection to another structure (e.g., a mounting for a door hinge), the structural integrity of such connection is better when the reinforcing member is on the inside of the tube because pulling on the fastened connection would tend to force the surface area of the reinforcing member into the tubular member, in contrast with a situation where deformation forced applied within the tube may cause separation of the tube from the reinforcing member when the reinforcing member is on the outside.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

What is claimed is:

1. A method of hydroforming a reinforced tube comprising:

providing a metal tubular blank having an interior defined by an inner surface and an exterior defined by an outer surface;

providing a metal reinforcing member;

inserting said metal reinforcing member into the interior of said tubular blank;

engaging said metal reinforcing member with said inner surface of said tubular blank;

attaching said reinforcing member to the inner surface of said tubular blank by welding;

placing said tubular blank and said reinforcing member welded thereto into a hydroforming die having die surfaces defining a die cavity; and providing pressurized fluid within said tubular blank so as to conform said tubular blank to said die surfaces of said die cavity, wherein said tubular blank has a wall thickness between said inner and outer surfaces and wherein said welding is accomplished by engaging a laser welding apparatus with the exterior surface of said tubular blank and laser welding said reinforcing member to the inner surface of said tubular blank through said wall thickness of said tubular blank, wherein said reinforcing member has a generally tubular configuration with an opened cross section and a surface facing said inner surface after said inserting, and wherein said engaging comprises expanding said opened cross section of said reinforcing member until said facing surface of said reinforcing member is conformed in surface-to-surface engagement with said inner surface.

2. A method of hydroforming a reinforced tube comprising:

providing a metal tubular blank having an interior defined by an inner surface and an exterior defined by an outer surface;

providing a metal reinforcing member;

inserting said metal reinforcing member into the interior of said tubular blank;

engaging said metal reinforcing member with said inner surface of said tubular blank;

attaching said reinforcing member to the inner surface of said tubular blank by welding;

placing said tubular blank and said reinforcing member welded thereto into a hydroforming die having die surfaces defining a die cavity; and providing pressurized fluid within said tubular blank so as to conform said tubular blank to said die surfaces of said die cavity, wherein said tubular blank having a wall thickness between said inner and outer surfaces and wherein said welding being accomplished by engaging a laser welding apparatus with the exterior surface of said tubular blank and laser welding said reinforcing member to the inner surface of said tubular blank through said wall thickness of said tubular blank, wherein said reinforcing member has a generally tubular configuration with an opened cross section and a surface facing said inner surface after said inserting, and wherein said engaging comprises expanding said opened cross section of said reinforcing member until said facing surface of said reinforcing member is conformed in surface-to-surface engagement with said inner surface, wherein said inserting is accomplished by mounting said reinforcing member on a mandrel and moving at least one of said mandrel and said tubular blank until said reinforcing member is disposed within the interior of said tubular blank.

3. A method according to claim 2, wherein said expanding is performed by expanding said mandrel until said facing surface of said reinforcing member is in contact with said inner surface of said tubular blank.

4. A method of hydroforming a reinforced tube comprising:

providing a metal tubular blank having an interior defined by an inner surface and an exterior defined by an outer surface;

providing a metal reinforcing member;

inserting said metal reinforcing member into the interior of said tubular blank;

engaging said metal reinforcing member with said inner surface of said tubular blank;

attaching said reinforcing member to the inner surface of said tubular blank;

placing said tubular blank and said reinforcing member attached thereto into a hydroforming die having die surfaces defining a die cavity; and providing pressurized fluid within said tubular blank so as to conform said tubular blank to said die surfaces of said die cavity, wherein said reinforcing member has a generally tubular configuration with an opened cross section and a surface facing said inner surface after said inserting, and wherein said engaging comprises expanding said opened cross section of said reinforcing member until said facing surface of said reinforcing member is conformed in surface-to-surface engagement with said inner surface.

5. A method of hydroforming a reinforced tube comprising:

providing a metal tubular blank having an interior defined by an inner surface and an exterior defined by an outer surface;

providing a metal reinforcing member;

inserting said metal reinforcing member into the interior of said tubular blank;

engaging said metal reinforcing member with said inner surface of said tubular blank;

attaching said reinforcing member to the inner surface of said tubular blank;

placing said tubular blank and said reinforcing member attached thereto into a hydroforming die having die surfaces defining a die cavity; and providing pressurized fluid within said tubular blank so as to conform said tubular blank to said die surfaces of said die cavity, wherein said inserting is accomplished by mounting said reinforcing member on a mandrel and moving at least one of said mandrel and said tubular blank until said reinforcing member is disposed within the interior of said tubular blank, wherein said reinforcing member has a generally tubular configuration with an opened cross section and a surface facing said inner surface after said inserting, and wherein said engaging comprises expanding said opened cross section of said reinforcing member until said facing surface of said reinforcing member is conformed in surface-to-surface engagement with said inner surface.

* * * * *